US009381624B1

(12) United States Patent
Patterson

(10) Patent No.: US 9,381,624 B1
(45) Date of Patent: Jul. 5, 2016

(54) STRIPPED SPARK PLUG EXTRACTION TOOL DEVICE

(71) Applicant: Paul S. Patterson, Brevard, NC (US)

(72) Inventor: Paul S. Patterson, Brevard, NC (US)

( * ) Notice: Subject to any disclaimer, the term of this patent is extended or adjusted under 35 U.S.C. 154(b) by 259 days.

(21) Appl. No.: 14/152,524

(22) Filed: Jan. 10, 2014

(51) Int. Cl.
*B25B 13/48* (2006.01)
*B25B 13/06* (2006.01)

(52) U.S. Cl.
CPC ..... *B25B 13/483* (2013.01); *B25B 13/065* (2013.01)

(58) Field of Classification Search
CPC .... B25B 13/483; B25B 13/065; B25B 27/18; B25B 23/103; B25B 23/105
See application file for complete search history.

(56) References Cited

U.S. PATENT DOCUMENTS 1,590,200 A * 6/1926 McGuckin ..... B25B 13/065 279/99
2,086,587 A * 7/1937 Thomson ..... B25B 13/44 279/36
2,670,639 A * 3/1954 Flowers ..... B25B 27/18 29/240
3,996,819 A * 12/1976 King ..... B25B 13/065 81/124.6
4,607,547 A 8/1986 Martus
4,671,141 A * 6/1987 Hanson ..... B25B 13/065 81/441
5,074,172 A 12/1991 Fetter et al.
5,361,654 A 11/1994 Rasipovitis
5,361,657 A 11/1994 Terry
5,551,320 A * 9/1996 Horobec ..... B25B 13/065 206/378
6,854,360 B2 * 2/2005 Chu ..... B21K 5/16 76/114
6,877,402 B1 * 4/2005 Pigford ..... B25B 27/18 81/121.1
D526,546 S 8/2006 Jircle et al.
7,104,164 B2 * 9/2006 Jirele ..... B25B 23/108 7/100
8,221,140 B2 7/2012 Schneider et al.
8,347,761 B2 * 1/2013 Goss ..... B25B 13/065 81/120
8,707,830 B2 * 4/2014 Huang ..... B25B 13/06 81/121.1
2005/0150331 A1 * 7/2005 Horobec ..... B25B 27/18 81/53.2
2005/0183548 A1 * 8/2005 Horobec ..... B25B 27/18 81/53.2
2007/0039422 A1 2/2007 Rogers
2007/0289426 A1 * 12/2007 Chaconas ..... B25B 13/06 84/52
2008/0245195 A1 * 10/2008 Lee ..... B25B 13/065 81/124.6
2014/0060260 A1 * 3/2014 Kluhsman, Jr. ..... B25B 27/0035 81/121.1

* cited by examiner

*Primary Examiner* — David B Thomas

(57) ABSTRACT

A stripped spark plug extraction tool device removes stripped spark plugs from an engine. The device includes a tubular member. A tubular member socket extends into a bottom end of the tubular member and is defined by a plurality of faces extending into the bottom end of the tubular member. A plurality of extensions extends from the faces of the tubular member socket inwardly toward a center of the tubular member socket. The extensions are configured for engaging a perimeter edge of a stripped portion of a spark plug to extract the stripped spark plug from an engine. A housing has a top face, a bottom face and a peripheral wall extending between the top face and the bottom face. The peripheral wall comprises a plurality of planar faces wherein an outer surface of the peripheral wall of the housing is configured to be engaged and rotated by a wrench.

12 Claims, 3 Drawing Sheets

STRIPPED SPARK PLUG EXTRACTION TOOL DEVICE

BACKGROUND OF THE DISCLOSURE

Field of the Disclosure

The disclosure relates to extraction tool devices and more particularly pertains to a new extraction tool device for removing stripped spark plugs from an engine.

SUMMARY OF THE DISCLOSURE

An embodiment of the disclosure meets the needs presented above by generally comprising a tubular member. A tubular member socket extends into a bottom end of the tubular member and is defined by a plurality of faces extending into the bottom end of the tubular member. A plurality of extensions extends from the faces of the tubular member socket inwardly toward a center of the tubular member socket. The extensions are configured for engaging a perimeter edge of a stripped portion of a spark plug to extract the stripped spark plug from an engine. A housing has a top face, a bottom face and a peripheral wall extending between the top face and the bottom face. The peripheral wall comprises a plurality of planar faces wherein an outer surface of the peripheral wall of the housing is configured to be engaged and rotated by a wrench.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
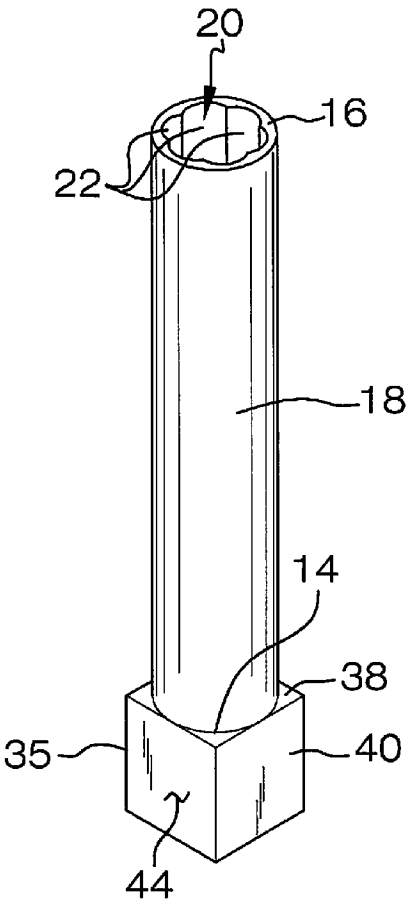
FIG. 2 is a bottom front side perspective view of an embodiment of the disclosure.
Figure 1:
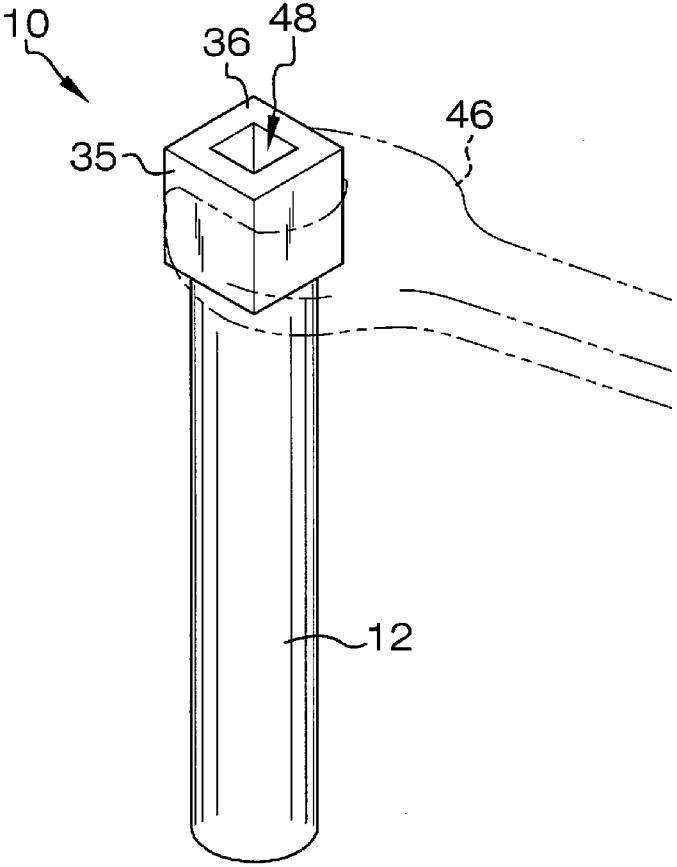
FIG. 1 is a top front side perspective view of a stripped spark plug extraction tool device according to an embodiment of the disclosure.
Figure 3:
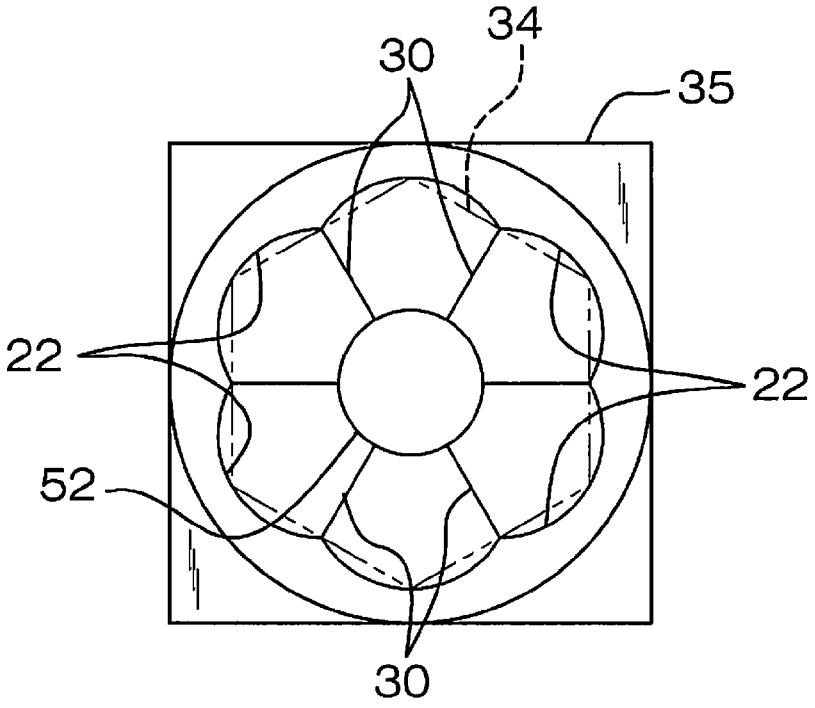
FIG. 3 is a bottom view of an embodiment of the disclosure.
Figure 4:
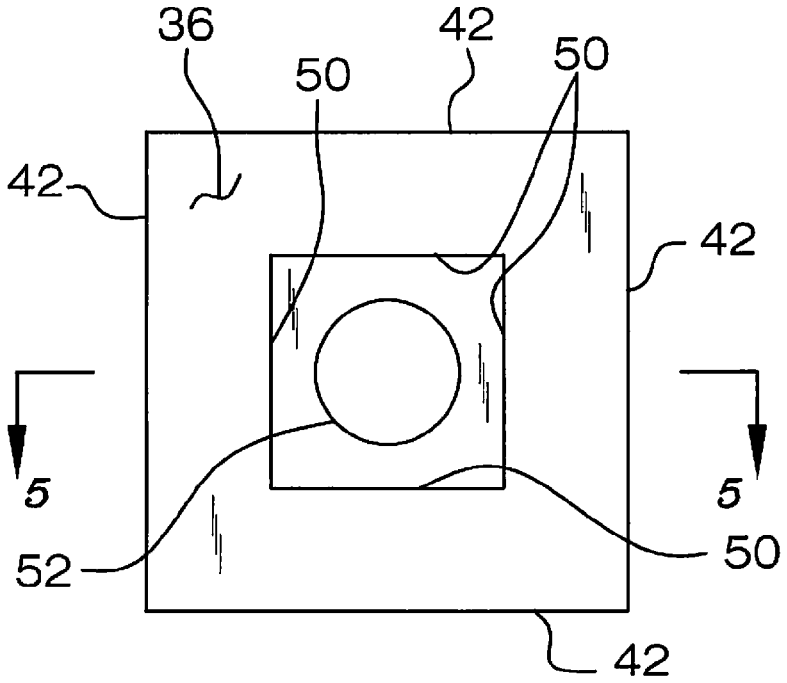
FIG. 4 is a top view of an embodiment of the disclosure.
Figure 5:
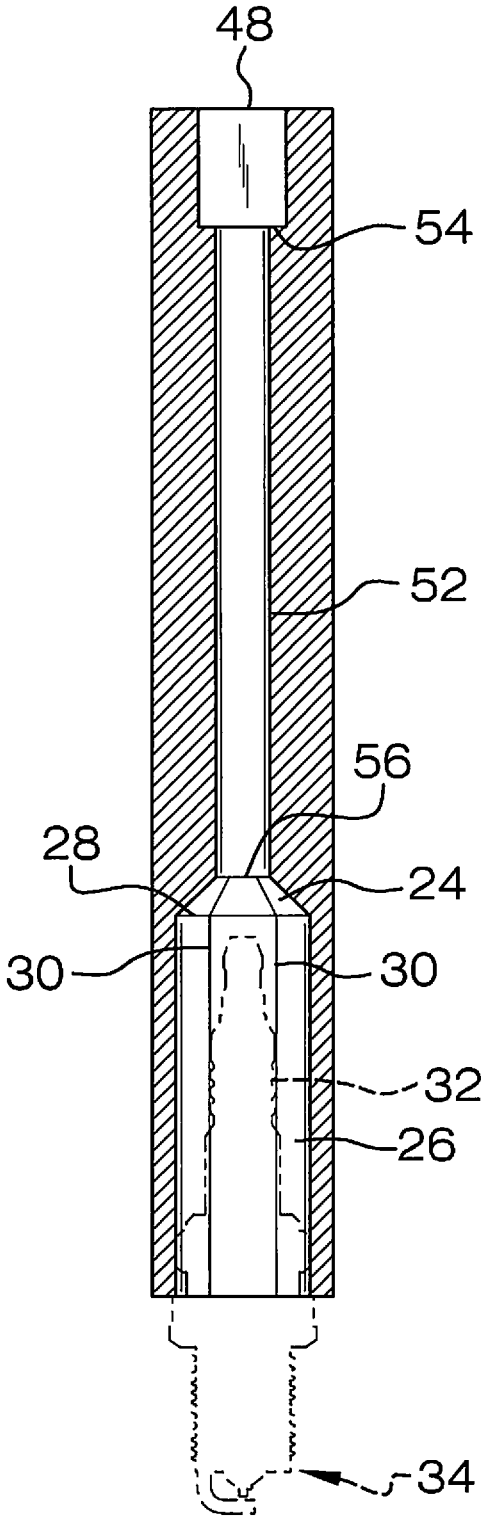
FIG. 5 is a cross-sectional view of an embodiment of the disclosure taken along line 5-5 of FIG. 4.

With reference now to the drawings, and in particular to FIGS. 1 through 5 thereof, a new extraction tool device embodying the principles and concepts of an embodiment of the disclosure and generally designated by the reference numeral 10 will be described.

As best illustrated in FIGS. 1 through 5, the stripped spark plug extraction tool device 10 generally comprises a tubular member 12 having a top end 14, a bottom end 16 and a perimeter wall 18 coupled to and extending between the top end 14 and the bottom end 16. The tubular member 12 is constructed from a rigid material such as steel or the like. A tubular member socket 20 extends into the bottom end 16 of the tubular member 12. The tubular member socket 20 is defined by a plurality of faces 22 extending into the bottom end 16 of the tubular member 12. The tubular member socket 20 includes an upper section 24 and a lower section 26. The upper section 24 may slant upwardly and inwardly away from a top end 28 of the lower section 26. Each face 22 of the lower section 26 is grooved. In particular, each face 22 of the lower section 26 may be concavely arcuate.

A plurality of extensions 30 is provided. The extensions 30 extend inwardly from the faces 22 of the tubular member socket 20 toward a center of the tubular member socket 20 wherein the extensions 30 are configured for engaging a perimeter edge of a stripped portion 32 of a spark plug 34 to extract the spark plug 34 from an engine. The extensions 30 can also be used to grip and extract a conventional nut that has been stripped. Each extension 30 is positioned between adjacent ones of the faces 22 of the lower section 26. Each extension 30 may be spaced an equal distance from an adjacently positioned extension 30.

A housing 35 has a top face 36, a bottom face 38 and a peripheral wall 40 coupled to and extending between the top face 36 and the bottom face 38. The peripheral wall 40 may comprise four planar faces 42 wherein an outer surface 44 of the peripheral wall 40 of the housing 35 is configured to be engaged and rotated by a wrench 46. A housing socket 48 extends into the top face 36 of the housing 35 wherein the housing 35 is configured to be engaged by insertion of a driving end of a ratchet into the housing socket 48 wherein the device 10 is configured to be rotated by the ratchet. The housing socket 48 is defined by a plurality of planar sides 50 extending into the top face 36 of the housing 35. The housing socket 48 is formed into a square shape. A slot 52 extends between a lower end 54 of the housing socket 48 and a top edge 56 of the upper section 24 of the tubular member socket 20. The slot 52 is narrower than each of the housing socket 48 and the tubular member socket 20.

The device 10 may have a total length between approximately 10.0 centimeters and 25.0 centimeters. The housing 35 may have a length between approximately 1.0 centimeter and 6.5 centimeters. The tubular member socket 20 has a size such that it is longer than conventional sockets.

In use, as stated above and shown in the Figures, the tubular member socket 20 is positioned over the stripped portion 32 of the spark plug 34 so that the indentations 30 releasably engage the spark plug 34. Either a wrench 46 or a ratchet is then used to engage the housing 35 to allow the spark plug 34 to be rotated by the wrench 46 or ratchet, respectively. In this manner, the device 10 facilitates removal of a stripped spark plug 34 from an engine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stripped spark plug extraction tool device comprising:

a tubular member having a top end, a bottom end and a perimeter wall coupled to and extending between said top end and said bottom end;

a tubular member socket extending into said bottom end of said tubular member, said tubular member socket being defined by a plurality of faces extending into said bottom end of said tubular member, said tubular member socket including an upper section and a lower section, said upper section slanting upwardly and inwardly away from a top end of said lower section;

a plurality of extensions, said extensions extending from said faces of said tubular member socket inwardly toward a center of said tubular member socket wherein said extensions are configured for engaging a perimeter edge of a stripped portion of a spark plug to extract the spark plug from an engine; and a housing having a top face, a bottom face and a peripheral wall coupled to and extending between said top face and said bottom face, said peripheral wall comprising a plurality of planar faces wherein an outer surface of said peripheral wall of said housing is configured to be engaged and rotated by a wrench.

2. The device of claim 1, further comprising said tubular member socket including a lower section, each said face of said lower section being grooved.

3. The device of claim 2, further comprising each said face of said lower section being concavely arcuate.

4. The device of claim 1, further comprising each said extension being spaced an equal distance from an adjacently positioned said extension.

5. The device of claim 1, further comprising wherein said peripheral wall comprises four planar faces.

6. The device of claim 1, further comprising a housing socket extending into said top face of said housing wherein said housing is configured to be engaged by insertion of a driving end of a ratchet into said housing socket.

7. The device of claim 6, further comprising said housing socket being defined by a plurality of planar sides extending into said top face of said housing.

8. The device of claim 7, further comprising said housing socket being formed into a square shape.

9. The device of claim 1, further comprising:

each said face of said lower section being grooved, each said face of said lower section being concavely arcuate;

each said extension being positioned between adjacent ones of said faces of said lower section, each said extension being spaced an equal distance from an adjacently positioned said extension;

said plurality of planar faces being four planar faces;

a housing socket extending into said top face of said housing wherein said housing is configured to be engaged by insertion of a driving end of a ratchet into said housing socket wherein said device is configured to be rotated by the ratchet, said housing socket being defined by a plurality of planar sides extending into said top face of said housing, said housing socket being formed into a square shape; and a slot extending between a lower end of said housing socket and a top edge of said upper section of said tubular member socket, said slot being narrower than each of said housing socket and said tubular member socket.

10. A stripped spark plug extraction tool device comprising:

a tubular member having a top end, a bottom end and a perimeter wall coupled to and extending between said top end and said bottom end;

a tubular member socket extending into said bottom end of said tubular member, said tubular member socket being defined by a plurality of faces extending into said bottom end of said tubular member;

a plurality of extensions, said extensions extending from said faces of said tubular member socket inwardly toward a center of said tubular member socket wherein said extensions are configured for engaging a perimeter edge of a stripped portion of a spark plug to extract the spark plug from an engine;

a housing having a top face, a bottom face and a peripheral wall coupled to and extending between said top face and said bottom face, said peripheral wall comprising a plurality of planar faces wherein an outer surface of said peripheral wall of said housing is configured to be engaged and rotated by a wrench; and each said extension being positioned between adjacent ones of said faces.

11. A stripped spark plug extraction tool device comprising:

a tubular member having a top end, a bottom end and a perimeter wall coupled to and extending between said top end and said bottom end;

a tubular member socket extending into said bottom end of said tubular member, said tubular member socket being defined by a plurality of faces extending into said bottom end of said tubular member;

a plurality of extensions, said extensions extending from said faces of said tubular member socket inwardly toward a center of said tubular member socket wherein said extensions are configured for engaging a perimeter edge of a stripped portion of a spark plug to extract the spark plug from an engine;

a housing having a top face, a bottom face and a peripheral wall coupled to and extending between said top face and said bottom face, said peripheral wall comprising a plurality of planar faces wherein an outer surface of said peripheral wall of said housing is configured to be engaged and rotated by a wrench;

a housing socket extending into said top face of said housing wherein said housing is configured to be engaged by insertion of a driving end of a ratchet into said housing socket; and a slot extending between a lower end of said housing socket and a top edge of an upper section of said tubular member socket.

12. The device of claim 11, further comprising said slot being narrower than each of said housing socket and said tubular member socket.

* * * * *